US007744386B1

(12) United States Patent
Speidel et al.

(10) Patent No.: US 7,744,386 B1
(45) Date of Patent: Jun. 29, 2010

(54) HIGH AMPERAGE BUSWAY SYSTEM

(75) Inventors: John Speidel, Highland Falls, NY (US); Vincent Gennarelli, Washingtonville, NY (US); Frank Reidmiller, Highland Lakes, NJ (US); Peter Eagleton, Yorktown Height, NY (US); Jose Cadena, Mt. Kisco, NY (US); Scott Wisniewski, Highland Falls, NY (US)

(73) Assignee: Lighting Services Inc., Stony Point, NY (US)

( * ) Notice: Subject to any disclaimer, the term of this patent is extended or adjusted under 35 U.S.C. 154(b) by 0 days.

(21) Appl. No.: 12/610,874

(22) Filed: Nov. 2, 2009

(51) Int. Cl.
*H01R 25/00* (2006.01)

(52) U.S. Cl. ..... 439/118

(58) Field of Classification Search ..... 439/118, 439/119, 120, 121
See application file for complete search history.

(56) References Cited

U.S. PATENT DOCUMENTS

| | | | | |
|---|---|---|---|---|
| 3,489,981 | A | 1/1970 | Corl et al. | |
| 3,503,032 | A | 3/1970 | Routh et al. | |
| 3,801,751 | A | 4/1974 | Ross, Jr. | |
| 3,801,951 | A | 4/1974 | Kemmerer et al. | |
| 3,933,403 | A * | 1/1976 | Rubesamen et al. | 439/121 |
| 4,179,174 | A | 12/1979 | Jorgensen | |
| 4,218,108 | A | 8/1980 | El Mouchi | |
| 4,655,520 | A | 4/1987 | Cummings | |
| 5,449,056 | A | 9/1995 | Ross | |
| 5,759,051 | A | 6/1998 | Cancellieri et al. | |
| 6,105,741 | A | 8/2000 | Ross | |
| 6,325,645 | B1 * | 12/2001 | Schuite | 439/110 |
| 6,517,363 | B2 | 2/2003 | Ross | |

OTHER PUBLICATIONS

PROfile Series; 60 Amp Busway—Surface Mounted One or Two Circuit—12V/120V/277V AR60S; U.S. Patent No. 6,517,363; RSA Lighting; www.rslighting.com; BWSF4-BWSF7 (4 pages); 2004.
PROfile Series; 60 Amp Busway—Suspension Mounted One or Two Circuit—12V/120V/277V AR60S; U.S. Patent No. 6,517,363; RSA Lighting; www.rslighting.com; BWSP8-BWSP13 (6 pages); 2004.
PROfile Series; 60 Amp Busway— Recessed Trimless Mounted One or Two Circuit—12V/120V/277V AR6OR; U.S. Patent No. 6,517,363; RSA Lighting; www.rslighting.com; BWTR20-BWTR23 (4 pages); 2004.

* cited by examiner

*Primary Examiner*—Phuong K Dinh
(74) *Attorney, Agent, or Firm*—St. Onge Steward Johnston & Reens LLC

(57) ABSTRACT

An electrical busway system comprising a busway uniquely configured for cutting to length in the field. Special connector devices are also disclosed, with features for engaging and immobilizing busway insulators to assure accurate initial alignment of conductors and contact elements prior to joining of connector devices with busway sections. An accessory device, specially adapted to the new busway design, includes a rotatable contact element, slideably received in its rotatable support, which progressively displaces a spring as the contact element is rotated into contact with a busbar carried by a busway insulator. Good electrical contact at both ends of the slideable contact element is assured. The accessory device also includes a positioning element which is rotatable with, but rotationally advanced with respect to, the contact elements, to accurately position, and substantially immobilize an insulator element prior to the contact elements being rotated into restricted, busbar-receiving recesses in the insulator element.

31 Claims, 12 Drawing Sheets

HIGH AMPERAGE BUSWAY SYSTEM

CROSS-REFERENCE TO RELATED APPLICATIONS

The invention relates to busway systems and particularly to such systems designed for standard voltages, typically 120 through 277 volts, and having significant current capacities in the range of 20-30 amperes. The invention relates to the design and construction of the busway itself and also to connectors and accessories for use with the busway.

FIELD OF THE INVENTION

Electrical distribution systems, for lighting and other power requirements often are comprised of busways, which can be surface mounted, suspended, or recessed, to which lighting fixtures, power outlets and the like may be attached. In a typical system, the busways comprise elongated housings having a downwardly opening, generally C-shaped configuration, and containing the necessary conductors and insulation. Various output devices can be physically attached to a housing at any point along its length, and such output devices have portions which extend upward into the housing and make connections with the conductors housed therein. Such busway systems are desirable in that they are relatively easy to install and modify, and in that they provide a high degree of flexibility in the location and re-location of output devices, such as lighting fixtures and power output devices.

Busway systems frequently are installed for multiple purpose utilization. For example, for a track lighting arrangement, a number of lighting fixtures can be installed at various points on various interconnected busways, while power outlets may also be installed on the same system. Many such systems must be designed for standard voltage levels of 120-277 volts and for current carrying capacities of up to 30 amperes in order to accommodate lighting fixtures as well as a variety of other output devices. For such systems, code requirements can be rather stringent and among other things require a substantial spacing between exposed conductor surfaces and surfaces of the surrounding metal of the housing. For relatively high capacity (e.g., 30 amp) systems, operating at the standard voltages utilized (e.g., 120-277 volts), the conductors typically are recessed at the ends of a busway section, in order to assure adequate spacing between the exposed conductor ends and the adjacent housing walls. This can create problems at the jobsite, where some sections of busway, typically provided in standard lengths, may have to be cut to a shorter length for particular installation requirements. As a practical matter, job-site cutting to length while providing for recessed conductors may be impossible or impractical, and it is typical for high capacity busways of conventional design to be factory cut to custom lengths. The requirement for factory cutting of custom lengths severely impacts the flexibility of the system, where changes may be desired during installation of the system or thereafter in order to make adjustments to the distribution pattern or to accommodate structural changes.

BACKGROUND OF THE INVENTION

Electrical distribution systems, for lighting and other power requirements often are comprised of surface mounted busways, to which lighting fixtures, power outlets and the like may be attached. In a typical system, the busways comprise elongated housings having a downwardly opening, generally C-shaped configuration, and containing the necessary conductors and insulation. Various output devices can be physically attached to a housing at any point along its length, and such output devices have portions which extend upward into the housing and make connections with the conductors housed therein. Such busway systems are desirable in that they are relatively easy to install and modify, and in that they provide a high degree of flexibility in the location and re-location of output devices, such as lighting fixtures and power output devices.

Busway systems frequently are installed for multiple purpose utilization. For example, for a track lighting arrangement, a number of lighting fixtures can be installed at various points on various interconnected busways, while power outlets may also be installed on the same system. Many such systems must be designed for standard voltage levels of 120-277 volts and for current carrying capacities of up to 30 amperes in order to accommodate lighting fixtures as well as a variety of other output devices. For such systems, code requirements can be rather stringent and among other things require a substantial spacing between exposed conductor surfaces and surfaces of the surrounding metal of the housing. For relatively high capacity (e.g., 30 amp) systems, operating at the standard voltages utilized (e.g., 120-277 volts), the conductors typically are recessed at the ends of a busway section, in order to assure adequate spacing between the exposed conductor ends and the adjacent housing walls. This can create problems at the jobsite, where some sections of busway, typically provided in standard lengths, may have to be cut to a shorter length for particular installation requirements. As a practical matter, job-site cutting to length while providing for recessed conductors may be impossible or impractical, and it is typical for high capacity busways of conventional design to be factory cut to custom lengths. The requirement for factory cutting of custom lengths severely impacts the flexibility of the system, where changes may be desired during installation of the system or thereafter in order to make adjustments to the distribution pattern or to accommodate structural changes.

SUMMARY OF THE INVENTION

The present invention is directed to a novel and improved form of high amperage busway system in which the busway sections are so configured and constructed as to render it possible and practical to field cut the sections to custom lengths, enabling on the job re-design or re-arrangement of the system without the delay and expense involved in obtaining factory cutting of custom lengths of the busway sections. The busway system of the invention utilizes an outer housing in conjunction with internal insulating members that are configured to provide substantial stand-off positioning of the conductors in all directions from adjacent housing walls that are exposed to the ends of the conductors. The arrangement is such that the exposed conductor ends, when flush with the ends of the housing and with the ends of the internal insulating supports, are spaced sufficiently far from any surface of the housing wall to satisfy the strict code requirements applicable to such busway systems. As a result, when it becomes necessary or desirable to cut a standard (e.g., 12 foot) length of busway to a shorter length, such operations may be done by workmen at the job site with standard cutting tools and without the need for special tools and/or procedures for recessing the exposed ends of the conductors, inserting additional insulation at the exposed ends, and/or bending the busbar ends to increase spacing.

The system of the invention, in addition to utilizing an advantageous form of housing section, also incorporates a new and unique form of conductor-positioning insulators elements. The new insulator elements are formed of a relatively rigid structural plastic material, having suitable insulating characteristics, and are shaped to provide significant stand-off spacers, both vertically and horizontally. Conductive busbars, preferably of a relatively flat configuration, are positioned and retained within recesses in the insulator elements, exposed to the interior of the housing and rigidly supported by underlying stand-off flanges. It should be understood that directional references herein, such as vertical, horizontal, lateral, etc., are exclusively to facilitate description and understanding and are not in any way to be considered a form of limitation on the inventions described herein.

To advantage, the insulator elements are formed with upper and lower vertical stand-off flanges which are received in retention slots in the housing. The dimensional relationships accommodate limited horizontal and vertical movement of the insulator, providing clearances to facilitate longitudinal insertion of the insulators into the housing. The insulator elements are also formed with opposed positioning channels for the reception of positioning elements on accessory devices, such as lighting fixtures, and of positioning flanges provided on insertable connector devices which serve to join adjacent busway sections and/or to connecting them to a power source. The connector devices are dimensioned for snug vertical fit between upper and lower walls of the housing, and the positioning flanges are arranged to engage the positioning channels as the connector is inserted into the housing to adjust the vertical position of the insulator as necessary to assure proper alignment of the connector with the busbar-retaining recesses, and also to immobilize the insulator with respect to the connector.

In the busway system of the invention, connectors of novel and improved design are employed to join adjacent busway sections. Busway connectors in general are well known. Those of the present invention are of improved design in providing an improved alignment features, in order to properly align the electrical elements of the connector with the conductive busbars of the busway, and in providing improved electrical elements in the connector and improved arrangements for the mounting thereof. The features of the invention are applicable to all forms of the connectors, straight, right angle, T-connectors, X-connectors, etc., with and without feeder features.

Other features of the invention are directed to significant improvements in the busway accessory attachments for establishing proper alignment and electrical connection for various accessories to the busway system, such as lighting fixtures, power outlets, etc. Typical such accessories commonly use a rotatable element which can be aligned in one position, to enable insertion into the busway cavity, and then rotated to a second position to establish electrical contact and to physically secure the attachment in position on the busway housing. The attachment devices of the present invention perform these functions in a superior manner and one that is optimized to the construction of the busway itself, assuring proper alignment and physical immobilization of the insulators and assuring good electrical contact with the internal busbars of the system.

For a more complete understanding of the above and other features and advantages of the invention, reference should be made to the following detailed description of a preferred embodiment thereof and to the accompanying drawings.

DETAILED DESCRIPTION OF THE INVENTION

Figure 1:
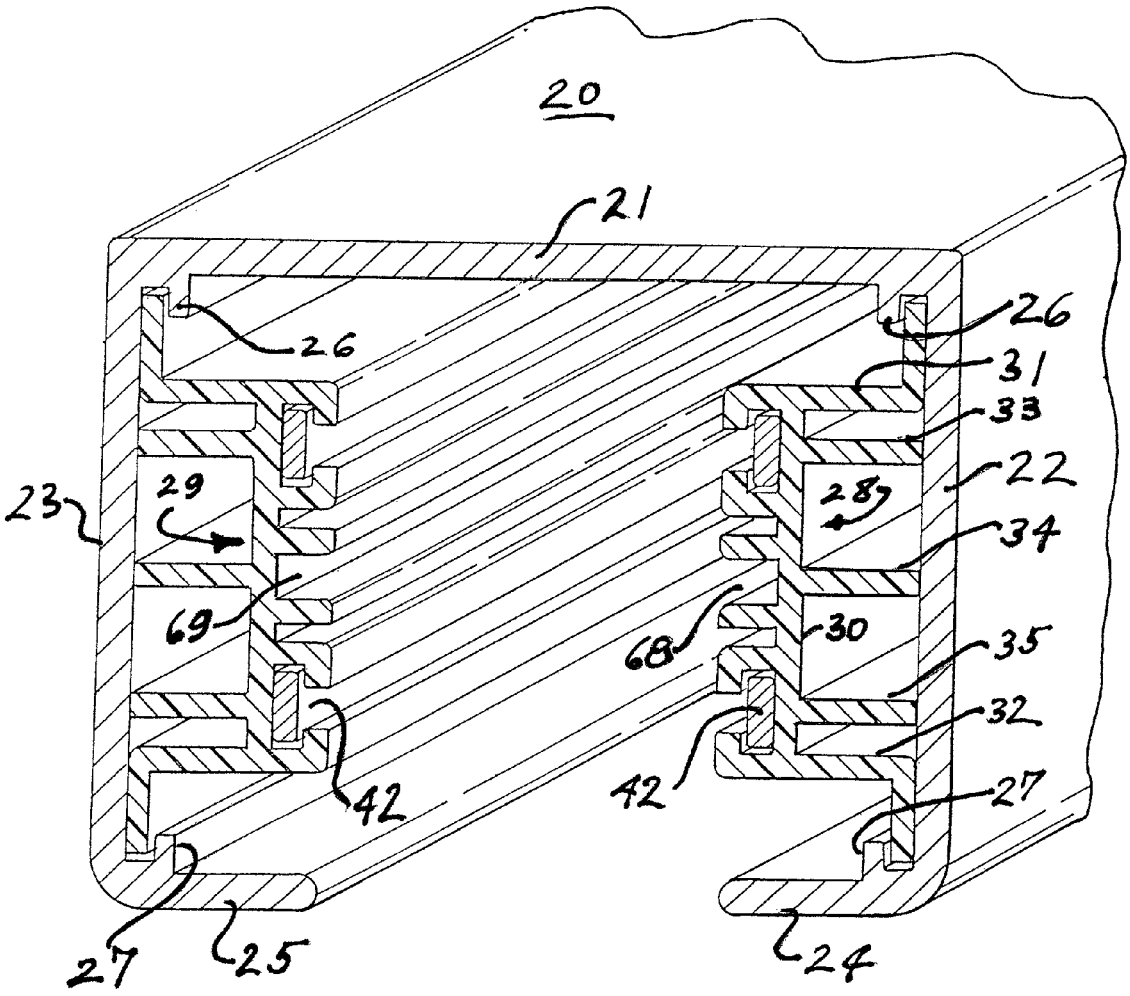
FIG. 1 is a transverse cross sectional view of a busway section incorporating features of the invention.
Figure 2:
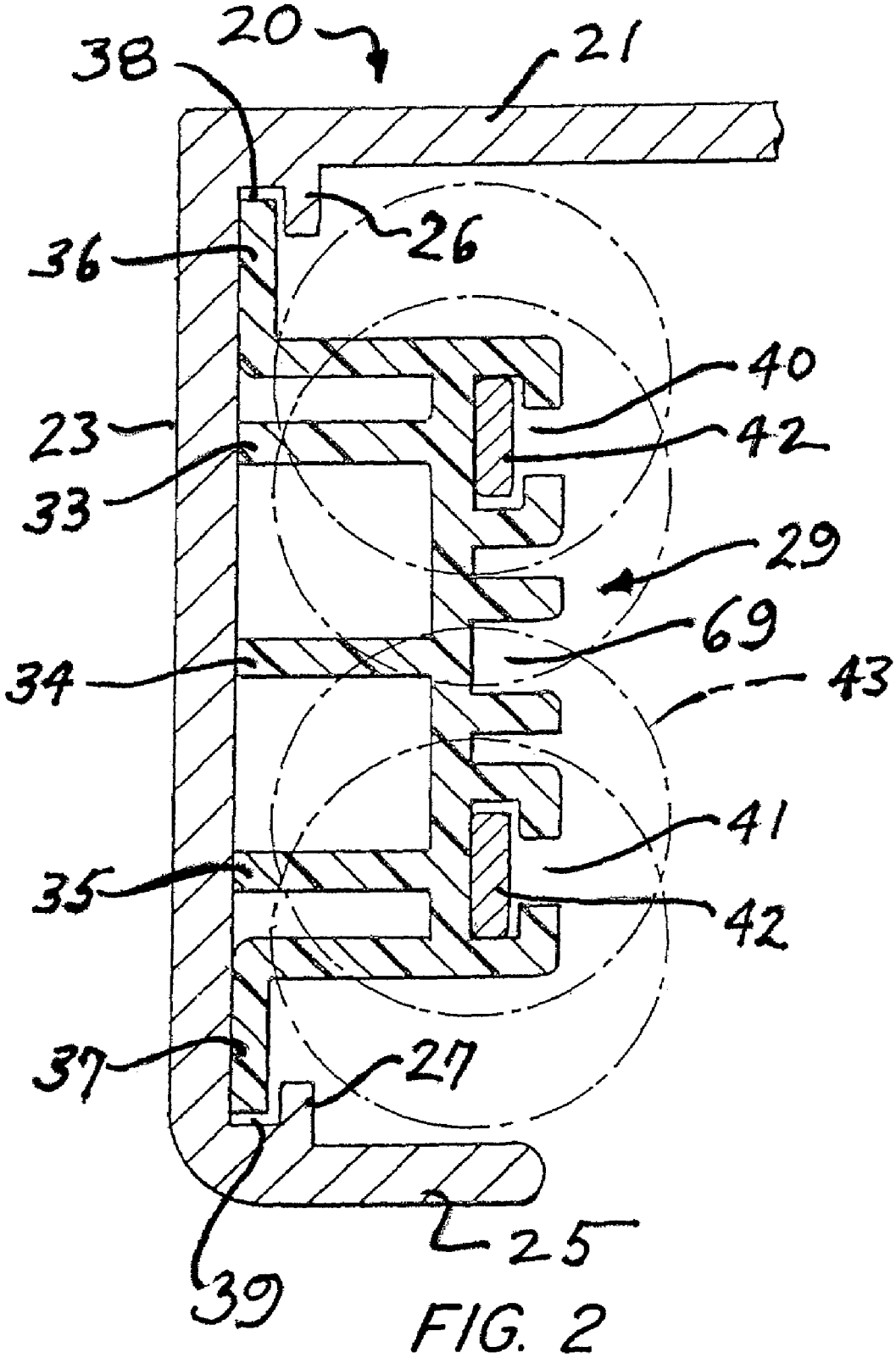
FIG. 2 is a diagrammatic partial transverse cross section as in FIG. 1, illustrating the standing-off positioning of the busway conductors in relation to the nearest adjacent housing walls.

Referring now to the drawings, and initially to FIGS. 1 and 2 thereof, the reference numeral 20 designates a busway housing, typically in the form of an aluminum extrusion, comprised of a flat top wall 21, opposite side walls 22, 23, also preferably flat, inwardly extending bottom flanges 24, 25. Adjacent each of the side walls 22, 23, and spaced a short distance inward therefrom, are upper and lower retaining flanges 26, 27 defining, with adjacent side walls, retention slots 38, 39 for engagement and retention of insulator elements 28, 29. Pursuant to one aspect of the invention, the insulator elements 28, 29 are specially configured to retain and support conductive busbars 30 such that the shortest distance from any point on any busbar, to any point on any surface of the housing 20, is equal to or greater than a predetermined minimum set by applicable codes for the spacing of exposed conductors. Thus, while the distance between a conductor and an adjacent housing wall may permissibly be substantially less than such predetermined minimum, where there is an intervening insulator, the busbars are exposed at the ends of the busway, and smaller distances, that may be acceptable with intervening insulation, may not satisfy code requirements at the ends of the busway, where there is a free air path between conductor and housing. With conventional busways intended for higher voltages (e.g., 120 v-277 v is typical standard voltage range for busway systems) it has been customary to cut the busbars to a shorter length than the housing surrounding them, in order to cause the ends of the busbars to be recessed a distance back from the ends of the housing. This makes field cutting of the busways very difficult and generally mandates that cutting of the busways to length be done at the factory, severely limiting the ability of the installing contractor to design or modify a busway installation at the job site.

In a preferred embodiment of the invention, the insulators 28, 29 advantageously are formed of a material such Noryl, a polystyrene modified polyphenylene oxide available from Sabic Innovative Plastics, Pittsfield Mass. Noryl is a dimensionally stable structural plastic with excellent electrical and flame resistant properties, and is particularly suited for the busway structure of the invention.

With reference to FIGS. 1 and 2, the insulators 28, 29 are extruded sections, comprised of a supporting platform 30 disposed parallel to and spaced horizontally from the housing side walls 22, 23, and supported in such spaced relation by means of upper and lower walls 31, 32 and intervening stand-off flanges 33-35. The upper and lower walls 31, 32 are joined at the inner faces of the housing walls 22, 23 by vertically disposed stand-off flanges 36, 37 which extend into retention the slots 38, 39 formed between the side walls 22, 23 and the retaining flanges 26, 27. The vertical stand-off flanges 36, 37 locate the insulators vertically within the housing 20 and also retain the insulators against the housing side walls. Desirably, there is a slight vertical and lateral clearance space between the vertical stand-off flanges and the retaining flanges 26, 27, to facilitate lengthwise insertion of the insulators 28, 29 into a busway housing 20, which may be of considerable length. Although such clearance space allows for some movement of the installed insulators, this is dealt with by means of advantageous features of the connectors and accessories utilized with the busway system, as will be described.

With reference to FIG. 2, the insulators 28, 29 are formed with inwardly opening recesses 40, 41 for the retention of conductive busbars 42, which extend the full length of the housings 20 and are flush at each end with the end surfaces of the housing. The openings of the recesses 40, 41 are narrower than the busbars, so that the busbars can be inserted and removed only in a longitudinal direction. To this end, the recesses are slightly larger than the busbars to facilitate such longitudinal insertion.

In accordance with the invention, the dimensioning of the vertical and lateral stand-offs 36, 37 and 33-35 is such that, at the exposed ends of any flat-cut section of busway, any exposed surface point of any busbar 40 is spaced form the nearest point on any surface of the housing by a distance which is greater than a predetermined, code-permitted distance. This is reflected by the circles 43 shown in phantom lines in FIG. 2. These circles are centered about the left side corners of the busbars 42, representing the points closest to internal surfaces of the housing 20. This important relationship allows the busways to be field cut to any length because it is not necessary to recess the conductive busbars back from the end face of the housing 20. The necessary distance is provided by the novel use of vertical and horizontal stand-offs 33-37.

Although the illustrated form of the invention embodies a two circuit system, with busbars 42 and insulators 28, 29 on both sides of the housing, many installations, or portions thereof, require only one circuit. In such cases, only one of the insulators, and one set of busbars will be utilized.

Figure 4:
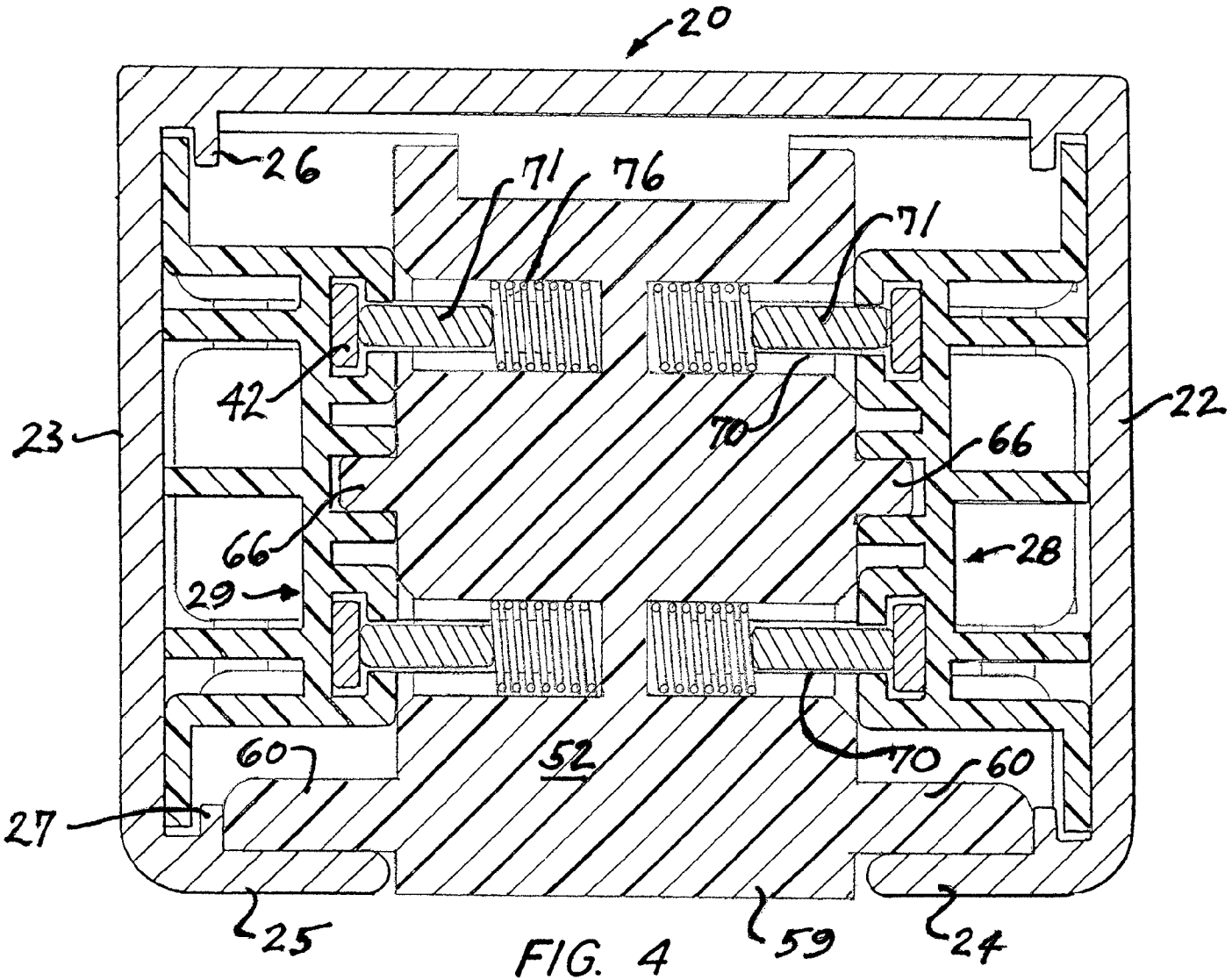
FIG. 4 is a cross sectional view similar to FIG. 3 but also including the connector in cross section.
Figure 5:
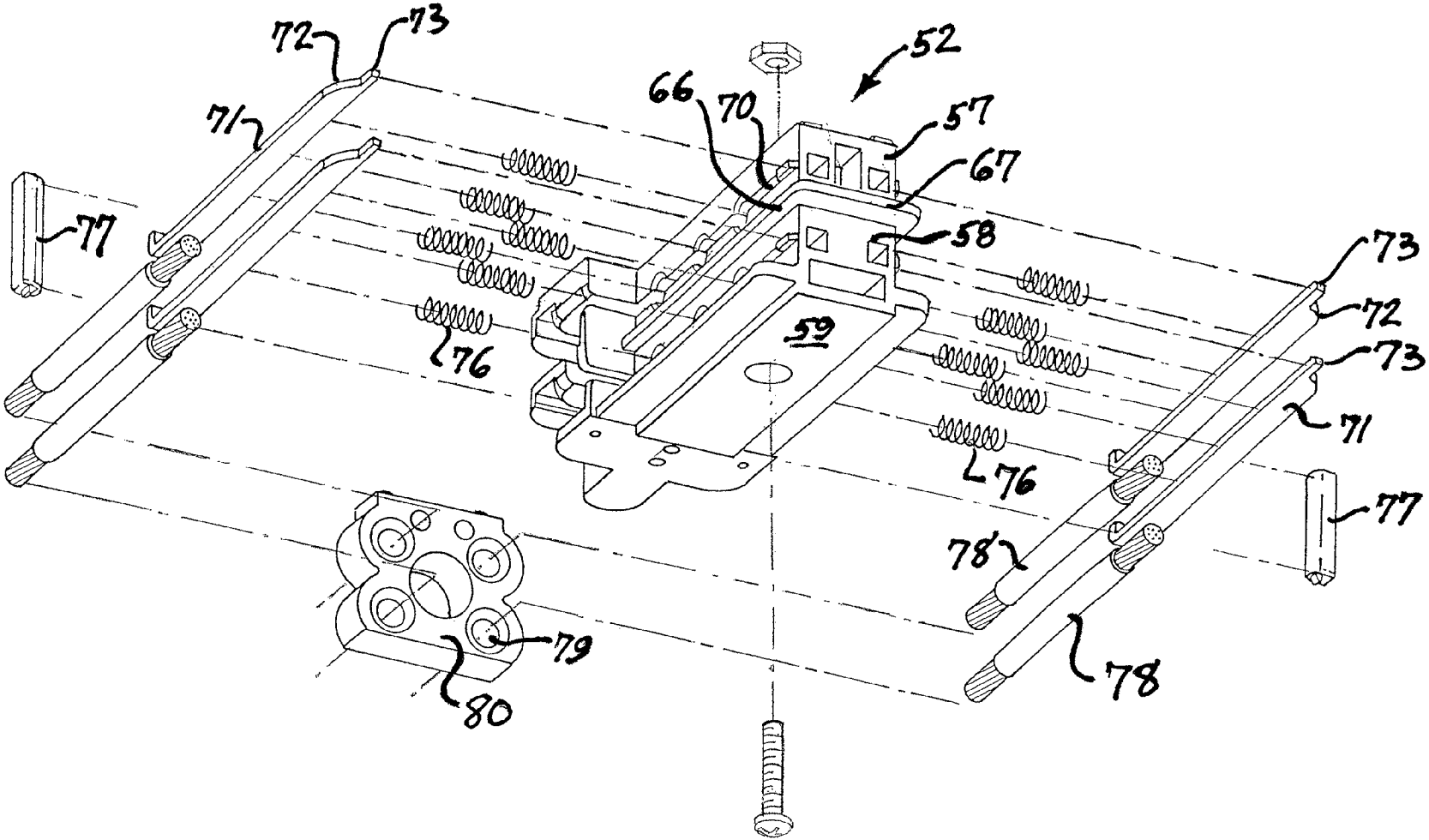
FIG. 5 is an exploded perspective view of an advantageous form of end assembly according to the invention for use in a connector.
Figure 6:
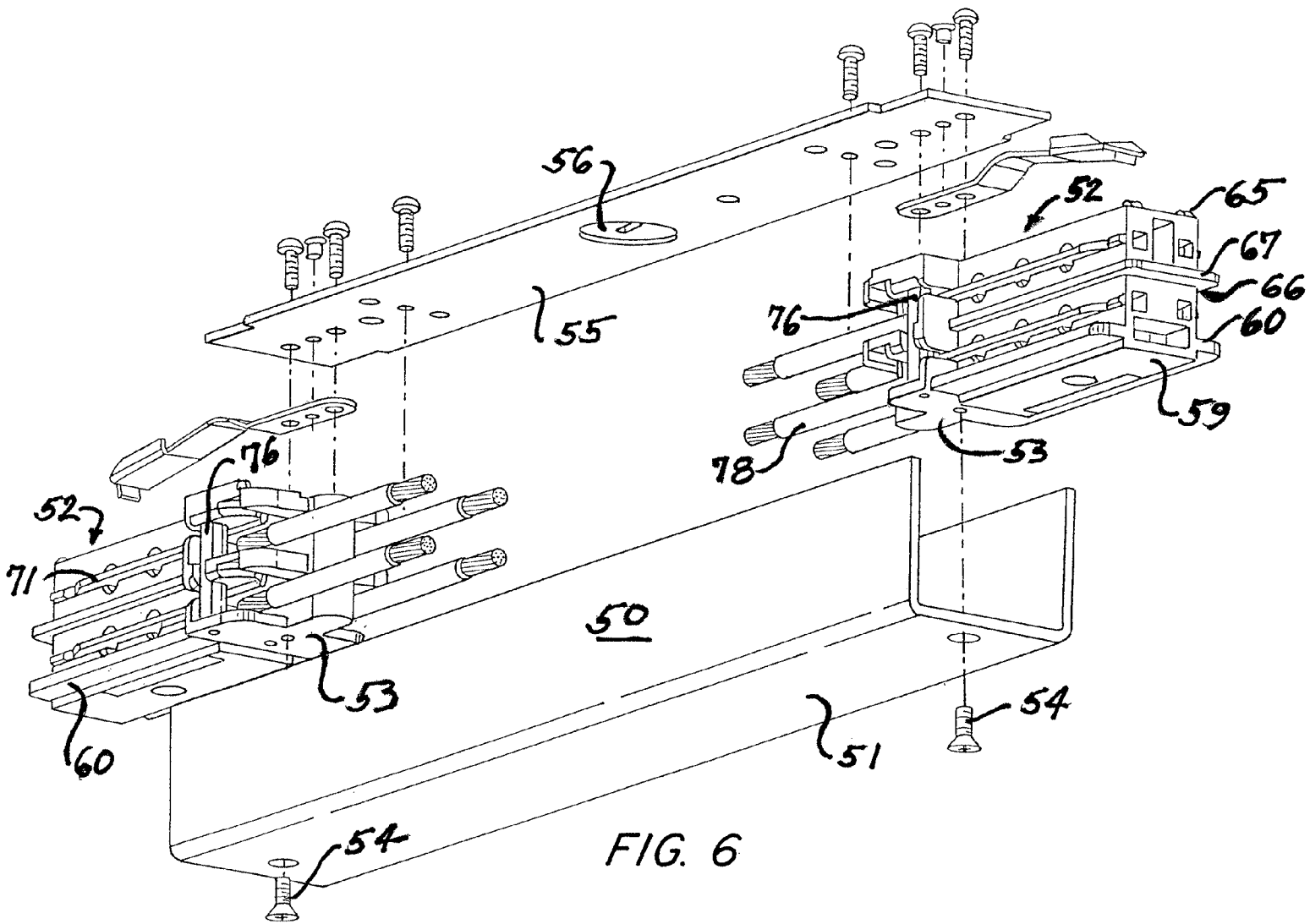
FIG. 6 is an exploded perspective view of straight connector incorporating the end assembly of FIG. 5 and configured to accommodate a feeder connection.
Figure 7:
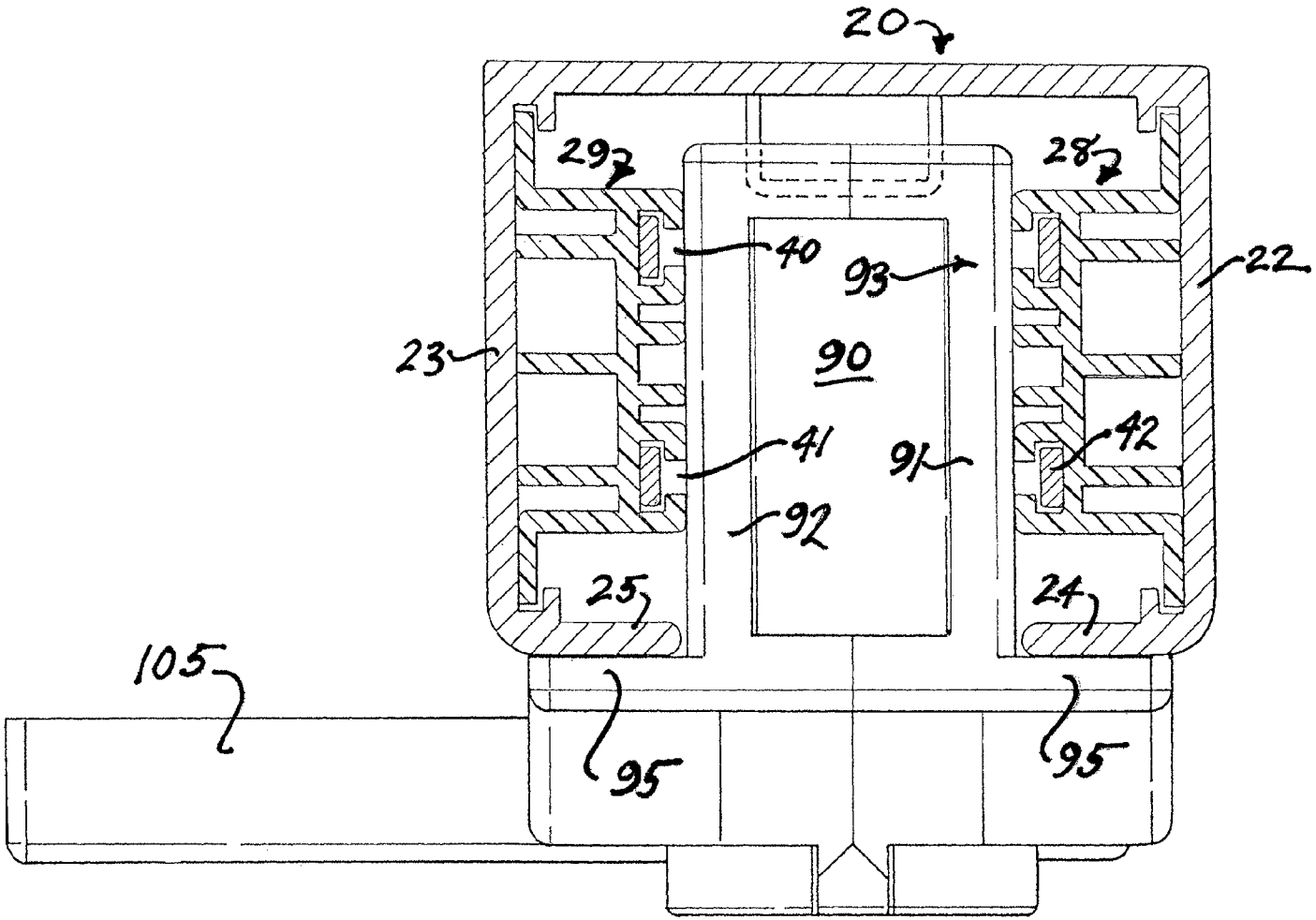
FIG. 7 is a transverse cross sectional view of the busway showing (in elevation) a output accessory being mounted therein.
Figure 8:
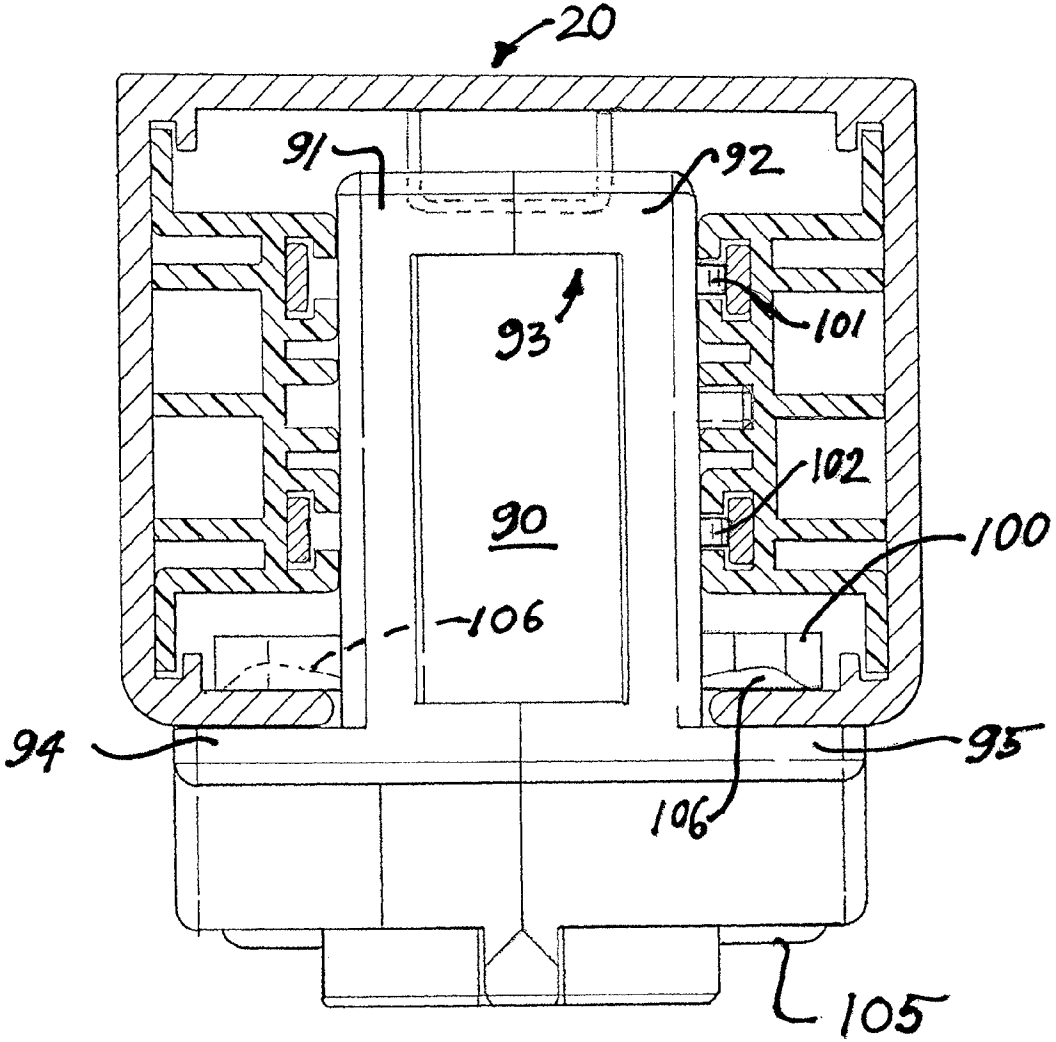
FIG. 8 is a cross sectional view, similar to FIG. 7 showing the output accessory installed and connected.

With reference now to FIGS. 3-6, there are shown novel features of connector devices designed especially for operating association with the busway housing and assembly of FIGS. 1 and 2 for connecting busway sections to each other and/or to a power supply. FIG. 6 is an exploded view of an end-to-end connector for joining two busway sections in line, and also provides for connection to a power source. The connector 50 comprises an outer housing 51 of U-shaped cross section, arranged to receive and mount outwardly extending end assemblies 52, shown in exploded detail in FIG. 5. The end assemblies are tightly secured by inner end portions 53 thereof to the connector housing 51 by bolts 54. A top cover 55 is secured to the upper portions of the end assemblies to substantially close the housing 51. In the illustrated form of the invention, the connector 50 is designed to connect with a power supply, and the cover 55 thus has a knock-out 56 for attachment to an incoming power cable (not shown). Alternatively, the connector may be configured for a straight-through connection, with no provision for connection to a power cable, and thus may have a shorter housing 51.

Figure 3:
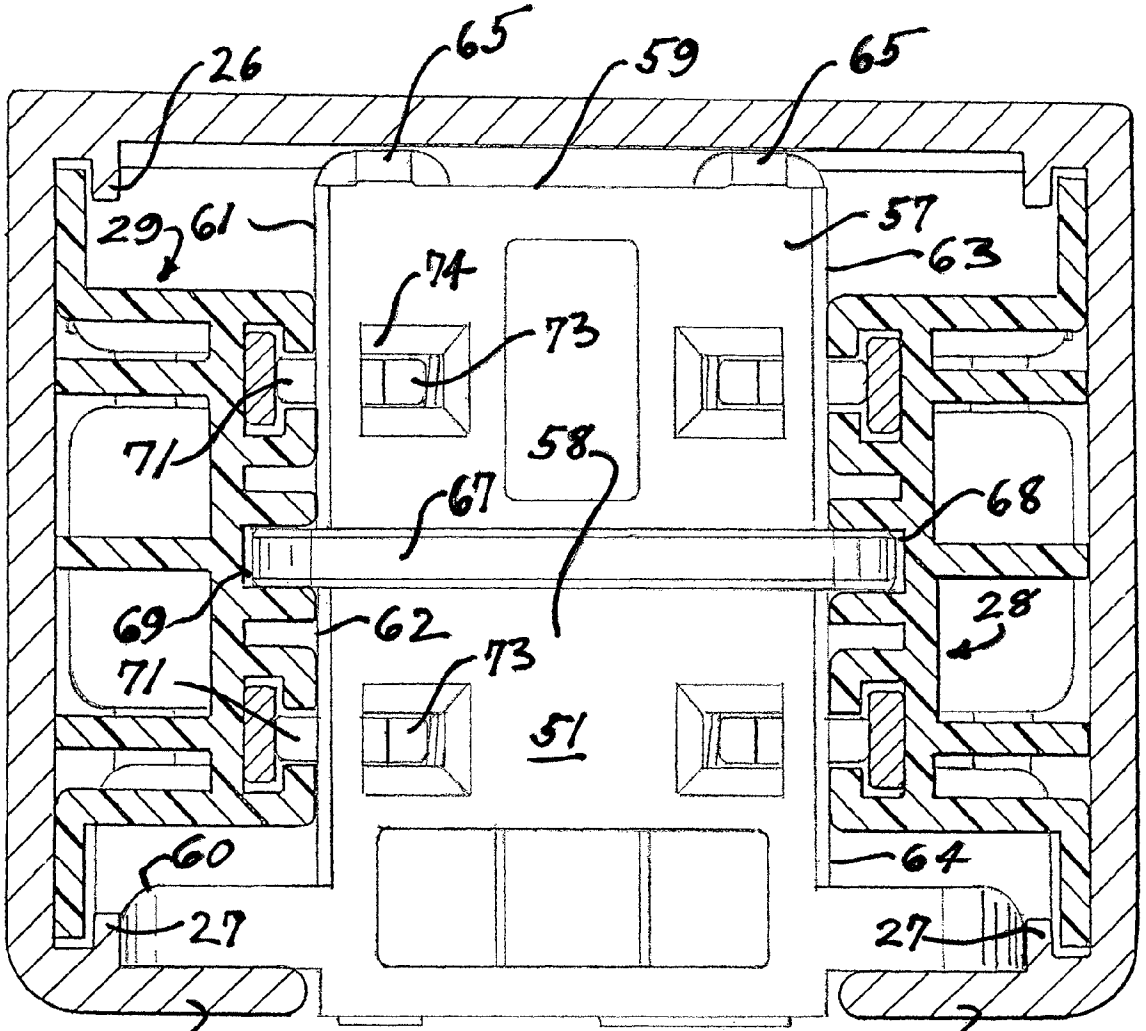
FIG. 3 is a transverse cross sectional view similar to FIG. 1, showing (in elevation) the end of a connector device installed therein.

In the illustrated form of the invention, the end assembly 52 comprises a feed block 59 having upper and lower portions 57, 58. The lower portion 58 is formed with a laterally extending supporting flange 60 which, when the end assembly is joined with a busway section by longitudinal insertion, rests on top of the bottom flanges 28, 29 of the main housing 20, as shown in FIG. 3. The side edges of the flange 60 desirably are received with a close fit to the retaining flanges 27, at the bottom of the housing, so that the end assembly is firmly positioned within the housing. In a similar manner, opposite side walls 61-64 of the end assemblies fit snugly against inwardly facing surfaces of the insulators 28, 29. The top of the upper part 57 of the end section is formed in one or more areas with positioning elements 65 which engage the inner surface of the housing upper wall 21. The dimensioning between the lower surface of the flange 60 and upper surfaces of the positioning elements 65 is such that, when the end assembly 52 is inserted longitudinally into the end of a busway section, the end assembly is snuggly engaged between the lower flanges 28, 29 and the upper wall 21 of the housing 20, as well as between the opposed insulators 28, 29.

As illustrated in FIGS. 5 and 6, the feed block 59 is formed with a positioning flange 66, which extends along both sides. In addition, a front portion 67 of the positioning flange extends across the front of the feed block and projects forward of the support flange 60 and the positioning elements 65. The positioning flange 66 has a thickness closely corresponding to the width (vertically) of positioning recesses 68, 69 formed in the insulator elements 28, 29. When the end assembly 52 is inserted into the end of a busway, the initial engagement takes place between the front portion 67 of the positioning flange 66 and the end portions of the positioning recesses 68, 69. The opposite sides of the flange front portion 67 enter the positioning recesses and engage the insulators 28, 29. After that initial engagement, the end assembly is manipulated vertically with respect to the housing 20, to align the support flange 60 and the positioning elements 65 with the housing. Upon proper alignment, the end assembly may be fully inserted into the housing as reflected in FIGS. 3 and 4. When so inserted, the end assembly is locked vertically with the insulators 28, 29 such that the insulators are both immobilized and accurately aligned with the end assembly.

In accordance with one aspect of the invention, the end assembly 52 is provided with unique and advantageous contact arrangements for establishing electrical contact between the busbars 42 and the connector 50. To this end, both the upper and lower portions 57, 58 of the feed block are formed with longitudinally extending slots 70 on opposite sides thereof in which are received elongated contact elements 71, typically formed of copper or other highly conductive material. Forward ends 72 of the contact elements are rounded or tapered and terminate in narrow, forward projections 73. The forward projections 73 are received in front recesses 74 in the end assembly, which serve to capture and retain the front ends of the contact elements, while accommodating a predetermined amount of inward and outward movement thereof.

Associated with each of the contact slots 70 is a plurality (three in the illustration) of laterally oriented recesses 75, arranged to receive coil springs 76, positioned on the inner sides of the contact elements 71 to urge the contact elements to outer limit positions. The outer limit position of each contact element is determined at the front end by the permitted movement of the forward projections 73 within the front recesses 74. At their inner ends, the contact elements 71 are constrained by a pair of abutment bars 77, which are attached to the end assemblies 52 after installation of the springs 76 and contact elements.

Conductor wires 78 of a flexible nature, preferably multistrand, are connected to inner ends of the contact elements 71 for connecting to other elements. In the illustrated device, connections can be made to corresponding contact elements at the opposite end of the connector 60 and/or to a power cable. The wires 78 lead from the contact elements through openings 79 in a guide block 80 fixed to the inner end of the assembly 52.

Before the connector 50 is joined with a busway section, the contact elements 71 are displaced to their laterally outermost positions by the springs 76. When the connector end assembly 52 is inserted into the end of the busway section, the insulators 28, 29 are first brought into precise alignment with the end assembly by means of the positioning flange 66-67. As shown in FIGS. 3 and 4, the slots 70 for receiving the contact elements 71 are positioned to be directly opposite the openings into the busbar recesses 40, when the positioning recesses 68, 69 are engaged by the positioning flange 66-67. Continued insertion of the end assembly 52 into the busway section causes the tapered/rounded leading ends 72 of the contact elements to engage the ends of the busbars 42, resulting in inward lateral displacement of the outer end portions of the contact elements. With continued insertion of the end assembly, the contact elements are progressively displaced until they become displaced along their full length. When the connector end 52 is fully inserted, the several contact elements 71 are in full length contact with respective busbars 42, along the full exposed portions of the contact element. The connection is significantly facilitated by the manipulation and accurate alignment of the insulators 28, 29 with the end assembly 52 at the beginning of the insertion process and before there is any engagement with the contact elements 71.

Figure 9:
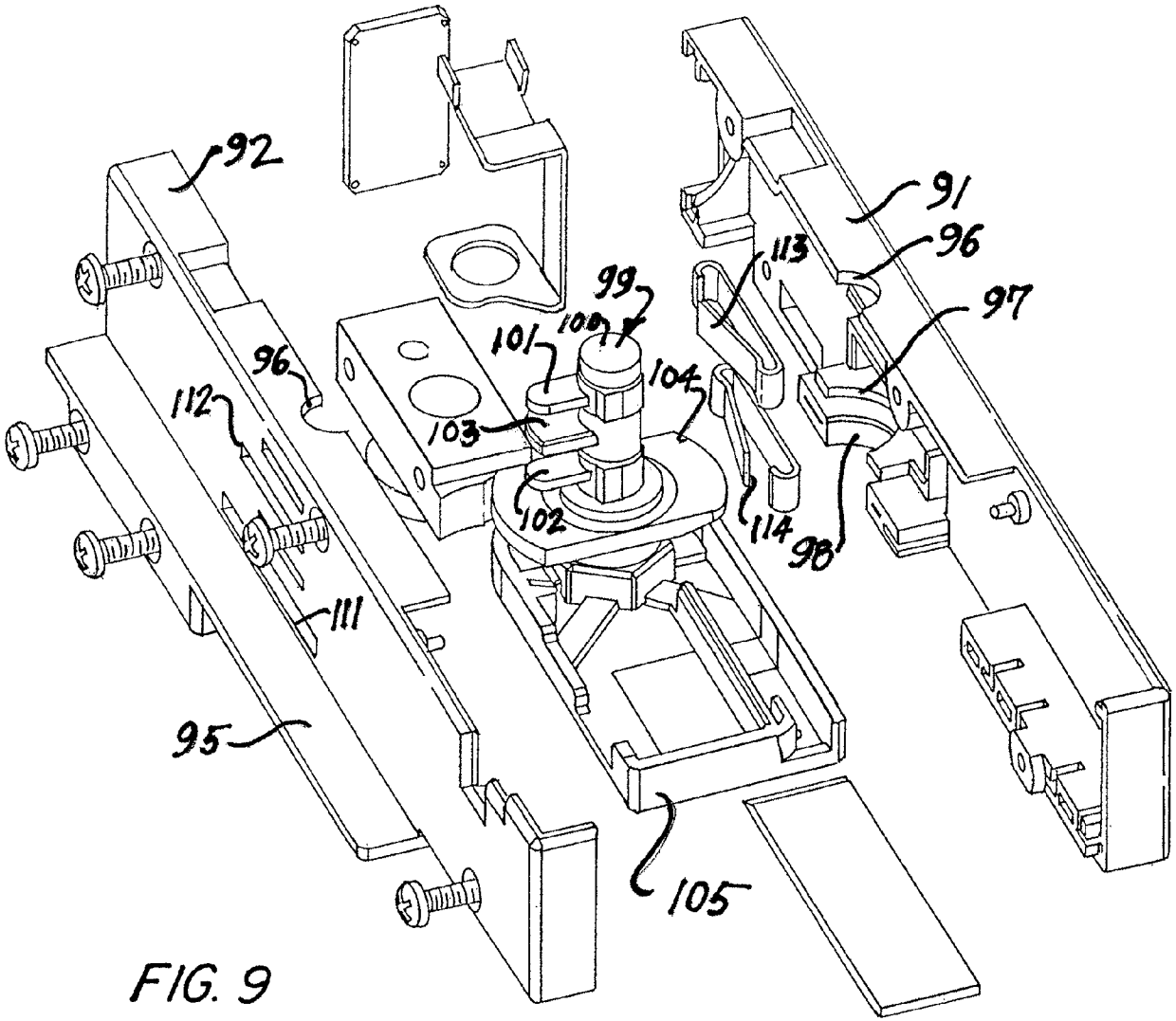
FIG. 9 is an exploded perspective view of an improved form of accessory device according to the invention.

With reference now to FIGS. 7-12 of the drawings there is shown an improved form of accessory device having features for particularly advantageous utilization with the disclosed busway system. A body member 90 of generally inverted T-shaped cross section is formed of opposed half sections 91, 92 (FIG. 9). The upper portion 93 of the body member is of a size and shape to fit snuggly between opposed insulators 28, 29 (FIGS. 7, 8) while the lowermost portion comprises laterally extending positioning flanges 94, 95. The flanges are arranged to be seated against the undersides of the housing flanges 24, 25.

The housing sections 91, 92 are formed with semicircular bearings 96-98 for mounting a rotatable member 99 for rotation about a vertical axis. The rotary member 99 (See FIG. 10) includes a shaft 100 in which are received electrical contact elements 101, 102, to be described further, which are arranged for limited sliding movement in a radial direction. A positioning arm 103, also to be described further, extends radially from the shaft 100 and is located midway between the two contact elements 101, 102. A mounting flange 104 extends from the shaft, at an axial location below the lower contact element 102.

Figure 10:
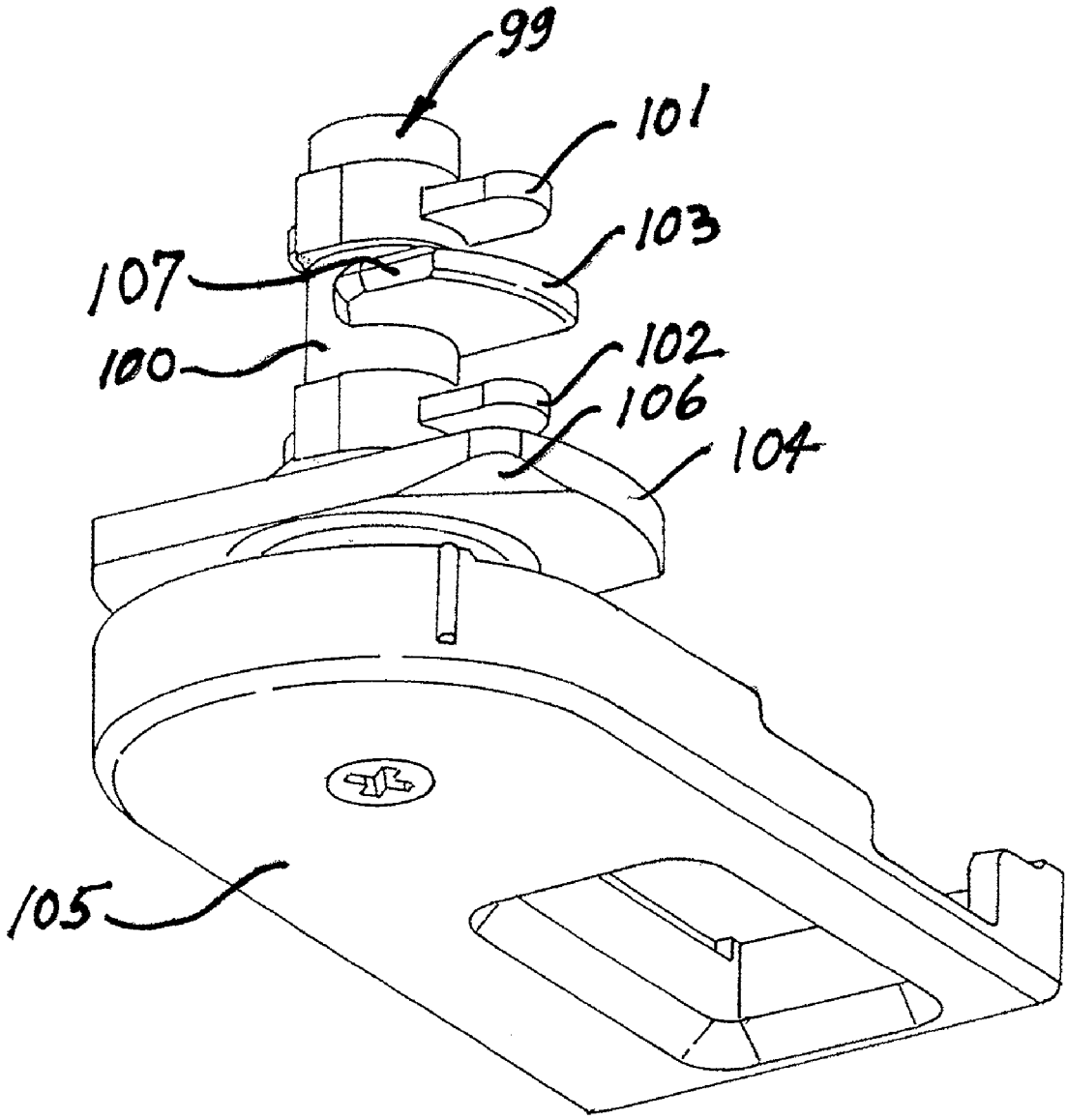
FIG. 10 is a perspective view of a rotary element incorporated in the accessory device of FIG. 9.
Figure 11:
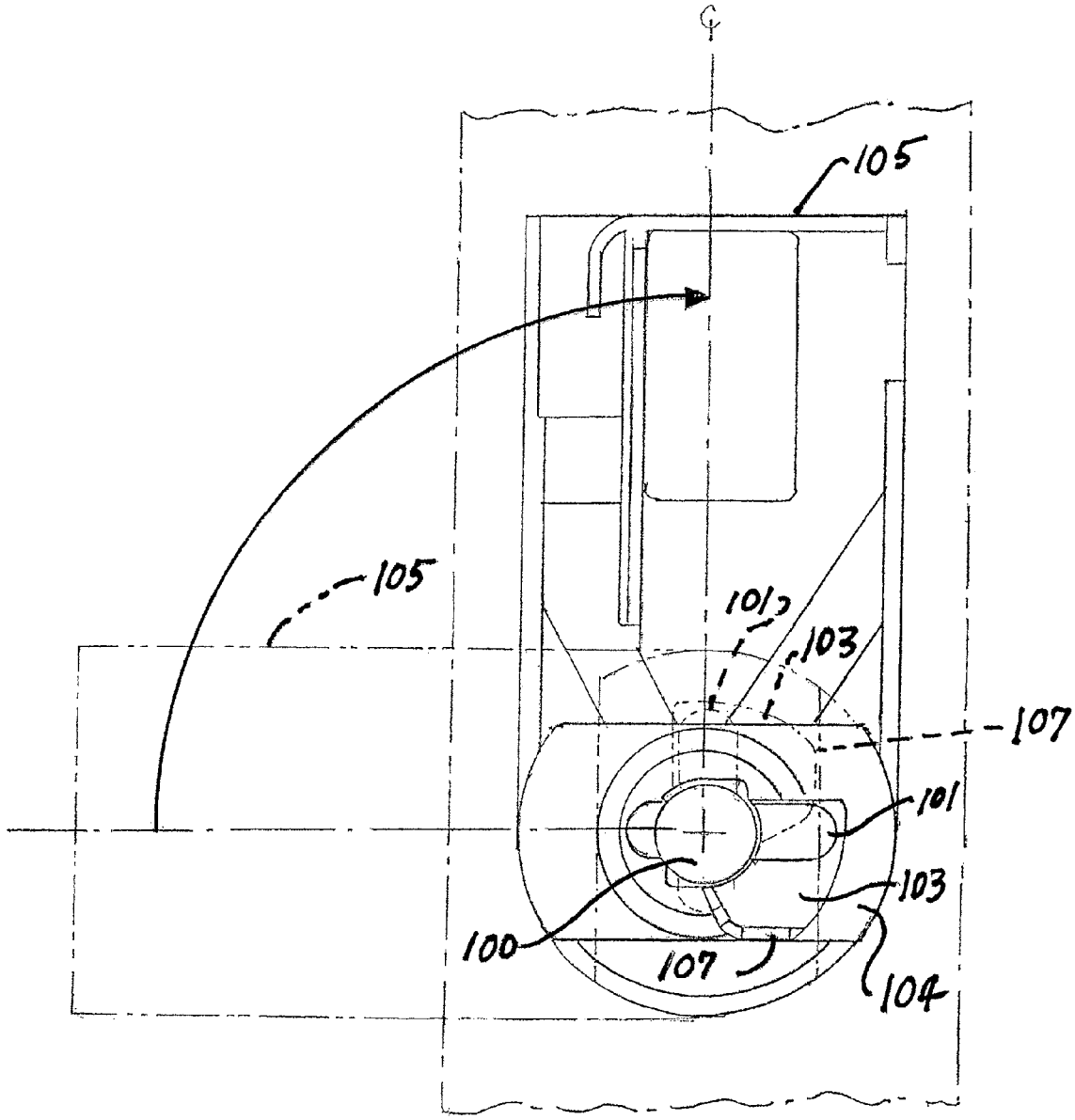
FIG. 11 is a top plan view of the rotary element of FIG. 10, illustrating its positions before and after installation.

As shown best in FIGS. 9 and 10, the mounting flange 104 has a width dimension slightly less than the spacing between the housing bottom flanges 28, 29 such that, when the flange 104 is oriented in alignment with the upper portion 93 of the accessory body 90, the accessory body can be inserted upward, into the cavity between insulators 24, 25 until the positioning flanges 94, 95 seat against the housing flanges 28, 29. In this position, the bottom surface of the mounting flange will be approximately level with the upper surfaces of the flanges 28, 29. When this position is reached, the shaft 100 is rotated clockwise (as viewed from above) 90°, causing the ends of the mounting flange to pass through slotted openings 111 in the housing parts 91, 92 and aligning the mounting flange 104 crosswise with respect to the flanges 28, 29 (FIG. 10) to secure the accessory body 90 within the busway housing 20. Desirably, the leading corner edges 106 of the mounting flange are beveled (FIG. 8) to facilitate initial engagement of the mounting flange with the housing flanges 28, 29.

In the illustrated form of the invention, rotation of the rotary member 99 is effected by means of a locking lever 105, which is fixed to the bottom of the shaft 100. When the lever 105 is positioned at right angles to the accessory body 90, as shown in broken lines in FIG. 11, the mounting flange 104 is aligned for insertion of the accessory into the busway housing. After such insertion, the locking lever is rotated 90° to a position of alignment with the accessory body 90. A particularly advantageous form of locking lever 105 forms the subject matter of our co-pending application Ser. No. 12/610,860 filed Nov. 2, 2009, entitled "Adjustable Lighting Fixture with Tool Holder" [06056-021P].

In accordance with one aspect of the invention, the positioning arm 103, which projects from the shaft 100, is located at level corresponding with that of the positioning recesses 68, 69 of the insulators 24, 25. When the lever 105 and shaft 100 are in the "insert" orientation (FIG. 7), the positioning arm is contained within the accessory body 90 to allow insertion into the housing. However, the leading edge 107 of the positioning arm, which is tapered as shown in FIG. 10, lies close to the edge of the body. Accordingly, as soon as the shaft 100 begins to be rotated by the locking lever 105, the tapered leading edge 107 passes through a slotted opening 112 in the housing part 92 and enters the adjacent positioning recess 68 or 69 (depending upon the orientation of the accessory), to position and substantially immobilize the related insulator 24 or 25. As is evident is FIG. 11, the leading edge 107 of the positioning arm is rotationally well ahead of the contact elements 101, 102, such that the insulator, and its busbar recesses 40, 41 are pre-positioned in accurate alignment to receive the contact elements as they are rotated into a position to enter the recesses.

To particular advantage, the contact elements 101, 102 are of a relatively rigid form and are mounted in the shaft 100 for free sliding movement in a radial direction. The contact elements are, however, limited in the extent of such sliding movement by pin 108 (FIG. 12), which extends axially through an upper portion of the shaft and through elongated, closed-ended slots 109 in the contact elements. The pin 108 is retained in the shaft 100 by a screw 110, which is used to secure the locking lever 105 to the shaft.

Figure 12:
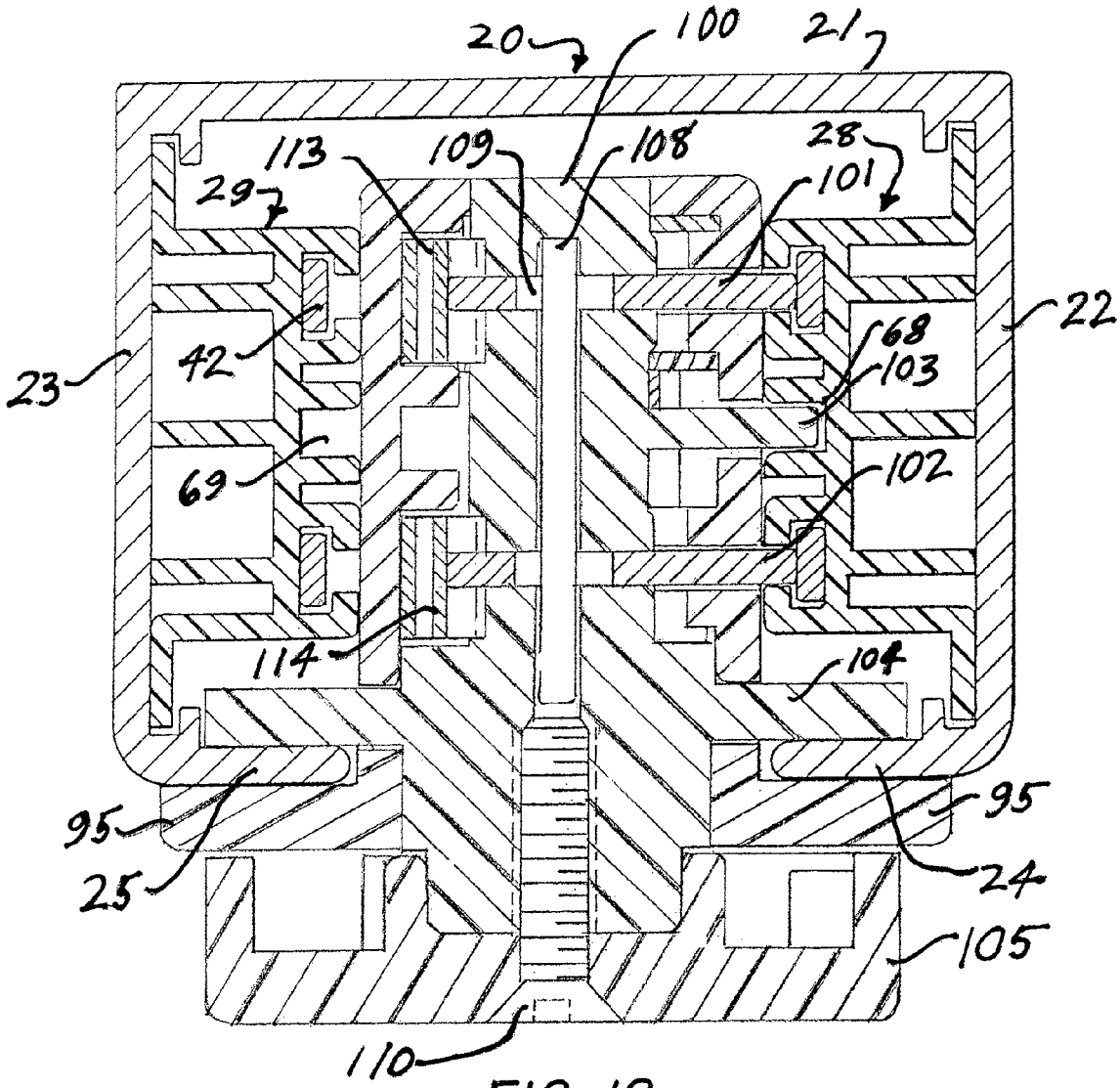
FIG. 12 is a cross sectional view through the busway, attachment device and rotary element.

As is evident in FIG. 12, the contact elements 101, 102 project asymmetrically from the shaft 100, with the "front" ends extending farther out from the shaft 100 than to the "back" ends. The housing part 92, is provided with a slotted openings 112 to enable the contact elements to project through and into the busbar recesses 40, 41 when the rotary member 99 is in a "lock" position, as in FIG. 12, when the accessory is installed.

As shown in FIGS. 9 and 12, spring elements 113, 114 are received in the housing part 91, aligned with the contact elements 101, 102 respectively. In accordance with the invention, when the rotary element 99 is aligned in the "insert" position, the contact elements are aligned longitudinally with the housing 90 and are completely out of contact with the spring elements 113, 114. After insertion of the accessory into the busway housing, the locking lever 105 is actuated to rotate the rotary element 99 and secure the accessory to the housing. As this rotation takes place, the contact elements are rotated to cause the front ends thereof to project outward through slots 115 provided in the housing part 92 and to cause the back ends of the contact elements to come into engagement with the spring elements 113, 114. With continued rotation into the "lock" position shown in FIGS. 9 and 12, the front ends of the contact elements extend into the busbar recesses 40, 41 and into contact with the busbars 42, while the back ends of the contact elements engage the spring elements 113, 114. With continued rotation, the extended front portions of the contact elements are displaced inwardly by the busbars 42, against the restraining action of the springs. As the rotation takes place, the opposite ends of the contact elements 101, 102 are sliding across the surfaces of the spring elements 113, 114 and the busbars 42 to assure good electrical contact at both ends of the contact elements. When the full "lock" position of the rotary member 99 is reached, the contact elements are disposed at right angles to the busbars 42, and the spring elements 113, 114 are fully displaced. In this configuration the spring elements maintain the contact elements 101, 102 in tight contact with the busbars 42.

The accessory shown in FIGS. 7-12 may be of various types. For example, it may mount a lamp and serve as a track lighting fixture, or may mount a power outlet for other plug-in devices. To this end, the spring elements 113 and 114 are formed of conductive material and are part of an electrical circuit comprising the busbars 42, the contact elements 101, 102, and the spring elements 113, 114. The spring elements 113, 114 are, in turn, connected to wires and other external circuitry (not shown), typically through internal fuses (not shown) and an internal switch (not shown). The switch advantageously is associated with the locking lever 105 in a manner that requires the switch to be in an "Off" position before the locking lever can be moved to a position (FIG. 7) to enable the accessory to be inserted into or removed from the busway section.

The busway system of the invention incorporates important and advantageous features which facilitate the initial design and installation of the system and which improve performance through related improvement features of associated accessory devices. In this respect, the busway design is such as to readily accommodate easy in-the-field cutting to length of the busway sections for standard voltage (e.g., 120-277 volts) systems. This is an important advantage over conventional systems, which typically require special tools and techniques for cutting to length and thus virtually mandate that cutting to length be done at the factory. The need for factory cutting is a serious impediment where changes from the original design of a busway system are desired or required, whether during the initial installation or in the course of subsequent modifications. Field cutting is enabled by the design of the busway housing and internal insulators such that, the shortest distance from any point on any busbar surface to any point on any surface of the housing is greater that required by applicable codes for uninsulated conductors, a condition that exists at the ends of the busway sections when all of the elements thereof are cut along the same plane. With the busway construction of the present invention, this is accomplished while maintaining an outer housing of compact configuration and dimensions. In conventional busbar systems, the necessary code spacing is achieved by operations such as recessing the cut ends of the busbars back from the end of the insulators, which is a very difficult thing to do in the field. Alternative procedures, such as inserting additional insulation at the ends of the busbars and/or bending the busbars inwardly at their ends are also difficult and time consuming to perform at the job site.

In the busway system of the invention, the insulator sections advantageously are mounted in the outer housing in a manner that accommodates a degree of looseness between the insulators and the housing. To this end, the new busway system incorporates plug-in connector devices of unique and advantageous construction which engage with the busway insulator sections in advance of any contact between busbars and contact elements of the connector device, so that the insulator sections are accurately aligned with and substantially immobilized with respect to the connector contact elements before the initial engagement of the contact elements with the busbars. This assures that the contact elements can properly enter the busbar recesses of the insulators and establish the desired engagement with busbars therein. The connector devices also incorporate an advantageous form of contact elements of a relatively rigid strip form, urged laterally outward by spring elements, preferably at multiple locations along the contact elements, to provide good electrical contact between the busbars and contact elements.

The busway system of the invention also incorporates accessory devices having novel and improved features particularly suited for cooperation with the above described busway sections. In particular, the accessory devices utilize a novel form of radially slideable contact elements which, when rotated into busbar-engaging position during installation of the accessory in a busway section, are engaged by spring elements urging the contact elements in a forward direction to extend the contact elements with respect to the rotary element in which they are mounted. As the contact elements are rotated toward their final positions, they are displaced rearwardly by the busbars. The spring elements are in turn displaced by the contact elements such that, in their final positions, the contact elements are in pressure contact, at one end with the busbars and at the other end with the spring elements, to provide good electrical contact from the busbars, through the contact elements and into the spring elements. The spring elements themselves are connected to output wires leading to an accessory output device, such as a lighting fixture, power outlet or the like.

To accommodate a degree of looseness between the busway housing and the insulators therein, the accessory devices of the invention utilize a positioning arm on the rotary member that carries the contact elements. The positioning arm is rotationally advanced relative to the contact elements and initially engages a positioning recess in the adjacent insulator. The positioning arm serves to accurately align and substantially immobilize the insulator with respect to the accessory device, thus assuring that the contact elements, rotationally following the positioning arm, can properly enter the busbar recesses in the insulator and make contact with the busbars.

It should be understood, however, that the specific forms of the invention herein illustrated and described are representative only of the invention, as many modifications may be made to the illustrated embodiment without departing from the teachings of the disclosure. Accordingly, reference should be made to the following appended claims in determining the full scope of the invention.

What is claimed is:

1. In a high capacity busway system of the type having an elongated metal housing of extruded metal construction which is substantially closed on top and sides thereof by top and side walls and partially closed on a bottom thereof by bottom flanges defining a longitudinally extending opening for receiving accessories, spaced apart, elongated insulators of extruded plastic construction positioned in said housing on opposite sides thereof and defining recesses for the reception of elongated, electrically conductive busbars elements, the improvement which comprises, (a) said housing being formed with upper and lower vertically extending retaining flanges extending a short distance vertically from said top wall and said bottom flanges and spaced a short distance inward from said side walls to form vertically opening retention slots, (b) said insulators being formed of relatively rigid plastic material and each having upper and lower stand-off flanges extending upward and downward from a body portion of said insulators and having end portions received in said retention slots to secure said insulators in position in said housing spaced vertically from said top wall and said bottom flanges, (c) a plurality of lateral stand-off flanges extending laterally outward from said body portions of said insulator and serving to space said body portions inwardly from the side walls of said housing, (d) each of said insulators having recess-forming flanges forming a plurality of inwardly opening busbar-retaining recesses therein for the reception and retention of said conductive busbar elements, said busbar-retaining recesses having inwardly directed openings of smaller width dimension than the width dimension of the busbar elements retained in said recesses, (e) laterally exposed outer surfaces of said recess-forming flanges being positioned generally above said housing flanges and defining in part an internal cavity within the housing for the reception of an accessory device, (f) said vertical and lateral stand-offs being so dimensioned, in relation to the positions of the busbar elements within said busbar-retaining recesses and in relation to the internal surfaces of said metal housing, that the shortest straight line distance from any point on any surface of any busbar element to any point on any internal surface of said housing is greater than a minimum, code-permitted distance for the designed electrical characteristics of the system.

2. The busway system of claim 1, wherein (a) the ends of said busbar elements being substantially flush with end edges of said housing in an installed configuration of said system.

3. The busway system of claim 1, wherein (a) said accessory device comprises a body portion having a width dimensioned for close reception between said insulator bodies, (b) said accessory device includes rotary contact elements rotatable about a vertical axis and movable through said inwardly directed openings and into compression contact with selected ones of said busbar elements, and (c) at least certain of said lateral stand-offs are aligned directly with said busbar-retaining recesses, such that said certain stand-offs directly oppose compression forces of said rotary contact elements against said busbar elements.

4. The busway system of claim 1, wherein (a) said accessory device comprises a body portion having a width dimensioned for close reception between said insulator bodies, (b) said accessory device includes rotary contact elements rotatable about a vertical axis and movable through said inwardly directed openings and into compression contact with selected ones of said busbar elements, (c) upper and lower extremities of said upper and lower stand-off flanges are separated by a distance less than a spacing between closed ends of said retention slots but greater than a spacing between open ends thereof, whereby said insulators have limited vertical movement with respect to said housing, (d) said accessory is mounted in a fixed position on said housing, (e) said insulators are formed with positioning recesses opening toward the interior of said housing, (f) said rotary contact elements are mounted on a rotator element, mounted in said accessory and engageable externally of said housing to rotate said contact elements into engagement with said busbar elements, (g) an insulator positioning element is mounted on said rotator element in general alignment with the positioning recess of an insulator and rotatable by said rotator element into said positioning recess in advance of the rotation of said contact elements into said inwardly opening busbar-retaining recesses to align and secure said insulator and said busbar-retaining recesses with respect to said rotary contact elements.

5. The busway system of claim 1, wherein, (a) upper and lower extremities of said upper and lower stand-off flanges are separated by a distance less than a spacing between closed ends of said retention slots but greater than a spacing between open ends thereof, whereby said insulators have limited vertical movement with respect to said housing, (b) end connectors are provided for joining busway sections, (c) said connectors comprise end portions formed of insulating material and of a size and shape to be insertable longitudinally into an end of said housing and to fit closely between said insulators, (d) said connectors have a plurality of longitudinally extending, laterally projecting contact elements spaced vertically to correspond with vertical spacing of the inwardly opening busbar-retaining recesses of said insulators and engageable, when a connector end portion is inserted longitudinally into said housing, with busbar elements within said recesses, (e) said connector end portions having positioning surfaces at the top and bottom thereof engageable with internal surfaces of said housing to confine and locate said end portions vertically within said housings, (f) said connector end portions further having insulator positioning flanges extending longitudinally along opposite sides thereof, (g) said insulators are formed with positioning recesses opening toward the interior of said housing, and (h) said insulator positioning flanges are closely received in said positioning recesses to vertically align and secure said insulators with respect to said connector end portions.

6. The busway system of claim 5, wherein, (a) said insulator positioning flanges project forwardly beyond the top and bottom positioning surfaces of said connector end portions, whereby said insulator positioning flanges are engaged with said positioning recesses prior to engagement of the positioning surfaces of said connector end portions with internal surfaces of said housings.

7. The busway system of claim 1, wherein (a) said insulators have upper and lower side walls joined with said upper and lower stand-off flanges, (b) said insulators are formed with inwardly opening positioning recesses therein for the reception of insulator positioning elements of accessories and connectors, and (c) said insulators include, in the region thereof between said side walls, first and second lateral stand-off flanges aligned with said conductor recesses and an additional stand-off flange aligned with said positioning recess.

8. A electrical busway system comprising (a) a busway section comprising an outer housing of uniform cross section comprising a top wall, opposed and spaced apart side walls, and opposed bottom flanges extending inward from lower edges of said side walls and defining a space between inner edges thereof, (b) electrical insulation received within said housing and defining opposed insulator sections associated with said housing side walls and a central space between said opposed sections, (c) said insulator sections each having a busbar recess therein, formed with an opening into said central space, for the reception and retention of an electrically conductive busbar, and provided with an inwardly opening positioning recess, (d) elongated electrically conductive busbars received in said busbar recesses with surfaces thereof exposed to said central space, and (e) a busway connector for mechanically joining with said housing and said insulation and electrically joining with said busbars, said connector comprising (f) a central body of a size and shape to be received closely within said central space, (g) supporting flanges extending laterally outward from said central body and engageable with upper surfaces of said housing flanges for supporting said central body within said housing, (h) positioning surfaces on the upper portions of said central body and engageable with lower surfaces of said housing top wall, (i) said supporting flanges and said positioning surfaces serving to snugly position said central body between said top wall and said housing flanges, (j) an insulation positioning flange having side portions projecting laterally from opposite sides of said central body and engageable with the positioning recesses of said insulator sections whereby, when said central body is inserted longitudinally into an open end of said housing, said insulator sections are accurately positioned and substantially immobilized with respect to said central body, (k) electrical contact elements movably supported within said central body and aligned with openings in said busbar recesses, and (l) resilient elements urging said contact elements outward and into contact with busbars within said busbar recesses.

9. An electrical busway system according to claim 8, wherein (a) said insulation positioning flange includes a front portion projecting forwardly of said central body and engageable with said insulator section positioning recesses upon longitudinal insertion of said central body into said outer housing, in advance of engagement of said of said supporting flanges and said positioning surfaces with said housing.

10. An electrical busway system according to claim 8, wherein (a) said central body is formed with outwardly opening, longitudinally extending slots aligned with said busbar recesses when said central body is inserted into said housing, (b) elongated contact elements are movably retained in said slots for limited lateral movement with respect thereto, (c) one or more spring elements are retained in said central body and positioned to act laterally outward on said contact elements, (d) outer portions of said contact elements being received in said busbar recess opening and maintained by said spring elements in pressure contact with said busbars.

11. An electrical busway system according to claim 10, wherein (a) said contact elements have front and back ends engageable with said central body to limit laterally outward movement of said elements, and (b) said one or more springs includes a plurality of coil springs acting on each contact element at spaced position along its length.

12. An electrical busway system according to claim 11, wherein (a) said contact elements are in the form of flat strip sections having a width dimension substantially greater than a thickness direction, and are supported in said central body for lateral movement in the width direction of said contact elements, and (b) said contact elements are tapered at the front ends thereof to cause said contact elements to be displaced inwardly when said central body is inserted longitudinally into said housing.

13. An electrical busway system according to claim 8, wherein (a) said contact elements have front and back ends and extend longitudinally in said central body, and (g) the back ends of said contact elements are connected to electrical conductors.

14. An electrical busway system according to claim 13, wherein (a) said busway connector includes provisions for connecting said electrical conductors to a source of electrical power for supplying power through said busway connector to said busbars.

15. An electrical busway system according to claim 13, wherein (a) said busway connector comprises a plurality of central bodies secured together in a spaced apart and angularly fixed relationship and each having contact elements, support flanges and positioning elements, and (b) electrical conductors connecting related contact elements of each of said central bodies, (c) said busway connector serving to mechanically and electrically join a plurality of busway sections.

16. An electrical busway system according to claim 15, wherein (a) said plurality of central bodies comprise at least two central bodies secured together in an angular relationship of 180° to provide a straight-through connection between two busway sections.

17. An electrical busway system according to claim 15, wherein (a) said plurality of central bodies comprise at least two central bodies secured together in an angular relationship of 90° to provide a right-angular connection between two busway sections.

18. An electrical busway system according to claim 15, wherein (a) said busway connector includes provisions for connecting said electrical conductors to a source of electrical power for supplying power through said busway connector to said busbars.

19. An accessory device for a busway system, where the busway system comprises (a) a busway section comprising an outer housing of uniform cross section comprising a top wall, opposed and spaced apart side walls, and opposed bottom flanges extending inward from lower edges of said side walls and defining a space between inner edges thereof, (b) electrical insulation received within said housing and defining opposed insulator sections associated with said housing side walls and a central space between said opposed sections, said housing accommodating limited vertical movement of said insulator sections, (c) at least one of said insulator sections having a vertically spaced pair of busbar recesses therein, each formed with an opening into said central space, for the reception of an electrically conductive busbar and said at least one insulator section being provided with an inwardly opening positioning recess, and (d) elongated electrically conductive busbars received in said busbar recesses with surfaces thereof exposed to said central space through said openings, (e) said accessory attachment comprising (f) an elongated central body closely receivable between said insulator sections and having a positioning flange engageable with the bottom flanges of said outer housing, (g) a rotary member rotatably mounted in said central body for rotation about a vertical axis and having a mounting flange extending from opposite sides of said axis, (h) said mounting flange having a width dimension less than the space between the bottom flanges of said housing and a length dimension greater than said space, and operative when rotated to a transverse position in relation to said central body to overlie upper surfaces of the bottom flanges of said housing and to cause said housing bottom flanges to be engaged between said mounting flange and said positioning flange, (i) said rotary member further mounting a pair of vertically spaced, radially extending and radially movable contact elements generally aligned with said mounting flange and arranged, when transversely disposed to said central body, to project transversely through a side wall of said central body and into said busbar recesses for contact with busbars therein, (j) one or more spring elements mounted in said central body and positioned to engage and act on said radially movable contact elements, when said elements are disposed transversely to said central body, to urge said contact elements into tight contact with adjacent busbars.

20. An accessory device according to claim 19, wherein (a) said radially extending contact elements pass entirely through said rotary member and have first portions extending from one side of said rotary member and second portions extending from an opposite side thereof, and (b) said one or more spring element engage said second portions of said contact elements when said contact elements are rotated to a position transversely disposed with respect to said central body.

21. An accessory device according to claim 20, wherein (a) said contact elements are provided with slots which extend lengthwise in said elements and are closed at both ends, and (b) a retaining pin extends axially in said rotary member and passes through said slots.

22. An accessory device according to claim 20, wherein (a) said one or more spring elements comprise a separate spring element for each contact element, (b) said spring elements are in the form of leaf springs mounted in said central body and having a length direction disposed horizontally in said central body, (c) each of said spring elements has a resiliently displaceable portion facing toward said rotary member and engageable with said second portions of said contact elements as said contact elements are rotated toward said transverse position.

23. An accessory device according to claim 19, wherein (a) said rotary member is formed with an outwardly extending positioning arm receivable in a positioning recess of an insulator section, (b) first portions of said positioning arm are generally aligned with said contact elements and second portions of said positioning arm are positioned circumferentially ahead of said contact elements, whereby said second portions engage and enter said positioning recess to position said insulator section in alignment with said contact elements in advance of said contact elements entering said busbar recesses.

24. An accessory device according to claim 23, wherein (a) said rotary element has a first operative position in which said mounting flange and said contact elements are substantially aligned with said central body and a second operative position in which said mounting flange and contact elements are oriented substantially at right angles to said central body, and (b) said second portions of said positioning element lie closely adjacent to said insulator section when said rotary element is in said first operative position whereby, upon initial rotation of said rotary element toward said second operative position, said positioning element engages said positioning recess and displaces said insulator section as necessary to assure alignment thereof with said contact elements in advance of said contact elements entering said busbar recesses.

25. An accessory device for a busway system, where the busway system comprises (a) a busway section comprising an outer housing of uniform cross section comprising a top wall, opposed and spaced apart side walls, and opposed bottom flanges extending inward from lower edges of said side walls and defining a space between inner edges thereof, (b) electrical insulation retained within said housing and defining opposed insulator sections associated with said housing side walls and a central space between said opposed sections, said housing accommodating limited vertical movement of said insulator sections, (c) at least one of said insulator sections having a vertically spaced pair of busbar recesses therein, each formed with an opening into said central space, for the reception of an electrically conductive busbar and said at least one insulator section being provided with an inwardly exposed positioning surface, and (d) elongated electrically conductive busbars received in said busbar recesses with surfaces thereof exposed to said central space through said openings, (e) said accessory attachment comprising (f) an elongated central body closely receivable between said insulator sections and having a positioning flange engageable with the bottom flanges of said outer housing, (g) a rotary member rotatably mounted in said central body for rotation about a vertical axis and having a mounting flange extending from opposite sides of said axis, (h) said mounting flange having a width dimension less than the space between the bottom flanges of said housing and a length dimension greater than said space, and operative when rotated to a transverse position in relation to said central body to overlie upper surfaces of the bottom flanges of said housing and to cause said housing bottom flanges to be engaged between said mounting flange and said positioning flange, (i) said rotary member further mounting a pair of vertically spaced, radially extending contact elements generally aligned with said mounting flange and arranged, when transversely disposed to said central body, to project transversely of said central body and into said busbar recesses for contact with busbars therein, (j) said rotary member being formed with an outwardly extending positioning arm engageable with a positioning surface of said at least one of said insulator sections, (b) first portions of said positioning arm being generally aligned with said contact elements and second portions of said positioning arm being positioned circumferentially ahead of said contact elements, whereby said second portions engage said positioning surface to position said one of said insulator sections in alignment with said contact elements in advance of said contact elements entering said busbar recesses.

26. An accessory device according to claim 25, wherein (a) said rotary element has a first operative position in which said mounting flange and said contact elements are substantially aligned with said central body and a second operative position in which said mounting flange and contact elements are oriented substantially at right angles to said central body, and (b) said second portions of said positioning element lie closely adjacent to said insulator section when said rotary element is in said first operative position whereby, upon initial rotation of said rotary element toward said second operative position, said positioning element engages said positioning surface and displaces said insulator section as necessary to assure alignment thereof with said contact elements in advance of said contact elements entering said busbar recesses.

27. An accessory device according to claim 25, wherein (a) said contact elements are radially movable in said rotary member and have first portions extending from one side of said rotary member and second portions extending from the opposite side thereof, and (b) one or more spring elements are mounted in said central body and are positioned to apply resilient pressure to said second contact element portions when said contact elements are oriented transversely to said central body.

28. An accessory device according to claim 27, wherein (a) a motion limiting element is associated with said contact elements to limit radial movement thereof with respect to said rotary member.

29. An accessory device according to claim 28, wherein (a) each of said contact elements is formed with a recess therein, and (b) a stop element is positioned on said rotary member and arranged for cooperation with said recesses to limit radial motion of said contact elements.

30. An accessory device according to claim 29, wherein (a) said contact element recesses are elongated slots in said contact elements, said slots being closed at each end, and (b) said stop element is a pin extending axially through a portion of said rotary element and said elongated slots.

31. An accessory device according to claim 25, wherein (a) said position surface is formed by a positioning recess provided in each of said insulator sections.

* * * * *